United States Patent [19]

Fagerroos

[11] Patent Number: 4,610,113

[45] Date of Patent: Sep. 9, 1986

[54] DRY CLEANING BOX

[76] Inventor: Mauno O. Fagerroos, Kyrönlukko C 27, 39100 Hämeenkyrö , Finland

[21] Appl. No.: 678,632

[22] Filed: Dec. 6, 1984

[30] Foreign Application Priority Data

Dec. 8, 1983 [FI] Finland ..... 834491

[51] Int. Cl.[4] ..... B24C 3/04

[52] U.S. Cl. ..... 51/425; 51/426; 51/410

[58] Field of Search ..... 51/426, 424, 425, 436, 51/410, 437, 421, 427, 319–320

[56] References Cited

U.S. PATENT DOCUMENTS

| | | | |
|---|---|---|---|
| 3,631,631 | 1/1972 | Greenstein | 51/427 |
| 3,858,360 | 1/1975 | Piet | 51/427 |
| 4,067,150 | 1/1978 | Merrigan | 51/436 |

FOREIGN PATENT DOCUMENTS

| | | | |
|---|---|---|---|
| 0831595 | 5/1981 | U.S.S.R. | 51/426 |
| 0856779 | 8/1981 | U.S.S.R. | 51/410 |

OTHER PUBLICATIONS

"Empire World of Impact Finishing"; catalog #780; pp. 24, 31; Empire Abrasive Equipment Corporation, Jun. 21, 1979.

*Primary Examiner*—Frederick R. Schmidt
*Assistant Examiner*—Robert A. Rose
*Attorney, Agent, or Firm*—Pearne, Gordon, Sessions, McCoy, Granger, & Tilberry

[57] ABSTRACT

The invention relates to a dry cleaning box for removing mill scale, slag, welding wastes, oxidations etc. from metal surfaces. A problem to be resolved is that different materials require different cleaning materials, whereby e.g. the cleaning of light metal casting must be effected with glass sand and the cleaning of steel with steel grit. According to the invention, this problem is resolved by the parallel use of different cleaning materials in a single machine. A box solution according to the invention comprises two ejector guns (1*a*, 2*a*), one (1*a*) of them passing the glass sand from the bottom part (1) of a cyclone to the surface to be cleaned. The other gun (2*a*), assisted by an additional ejector (2) mounted on the bottom part of a cone, passes the steel grit to the surface of a workpiece to be cleaned for cleaning hard pieces of e.g. steel or cast iron. In both operations, dusts travel along a duct (3) into the cyclone and further along a duct (4) to dust microfilters (5) in the bottom section of the machine from which dusts are shaken into a bin (6) and further to litter.

12 Claims, 4 Drawing Figures

DRY CLEANING BOX

The present invention relates to a dry cleaning box for removing solid dirt, e.g. crust, mill scale, slags, paint traces, oxidations etc. from metal pieces. Aside from the pieces made of steel or cast iron, the cleaning is generally effected with some relatively gentle cleaning material, such as glass sand, crushed nutshell and the like. The effective cleaning of steel and cast iron requires a high working pressure resisting blasting material, such as steel or cast iron grit. A drawback in view of the effective use of these blasting materials has been the tedious change of blasting materials, said drawback being eliminated in the present invention by the parallel operation of two systems having different operating principles.

Pieces made of various metals, such as steel, cast iron, brass, aluminum etc., are presently cleaned at the industrial depots by means of two methods, one of them employing in parallel two dry cleaning boxes, one with glass sand and the other with steel grit. This method naturally requires the acquisition of two devices or units, which increases investment costs by 100% and requires a lot of space.

The other prior known method employs a single dry cleaning box in which the blasting material is changed as required by a material to be cleaned. In this type of box, the bottom section of a suction cone is provided with a gate for removing the blasting material to be changed, the gate is closed and another cleaning material is poured to the bottom of said cone. This type of box and method involve several drawbacks. The change takes a lot of time and is a very dusty procedure. Workers are not very eager to change the cleaning material and this leads to less effective use of the device. When the change is neglected and steel and cast iron surfaces are attempted to be cleaned with glass sand, it is general practice to try and increase the working pressure from 4 bars to 7–9 bars. This achieves no substantial improvement in working efficiency but, instead, glass sand rapidly bursts into dust with a result that the filters are quickly clogged and visibility to the surface of a piece to be cleaned deteriorates. Also in terms of economy, the use of glass sand for cleaning steel and cast iron pieces is highly unfavorable as the price of steel grit is just half of that of glass sand and, respectively, the non-abradability ratio of these materials is glass sand/steel grit 1:100.

An object of the invention is to provide a dry cleaning box which employs in parallel two systems having different operating principles.

Figure 1:
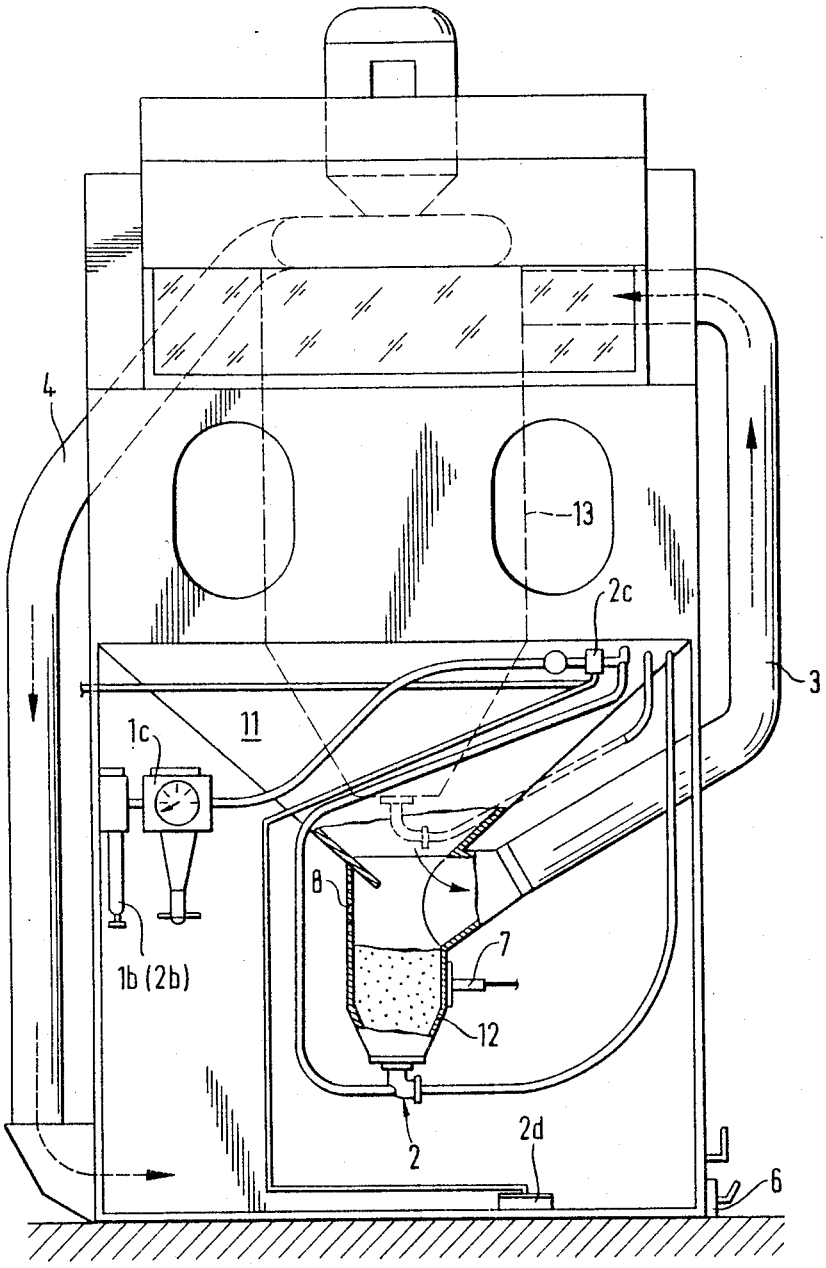
Figure 2:
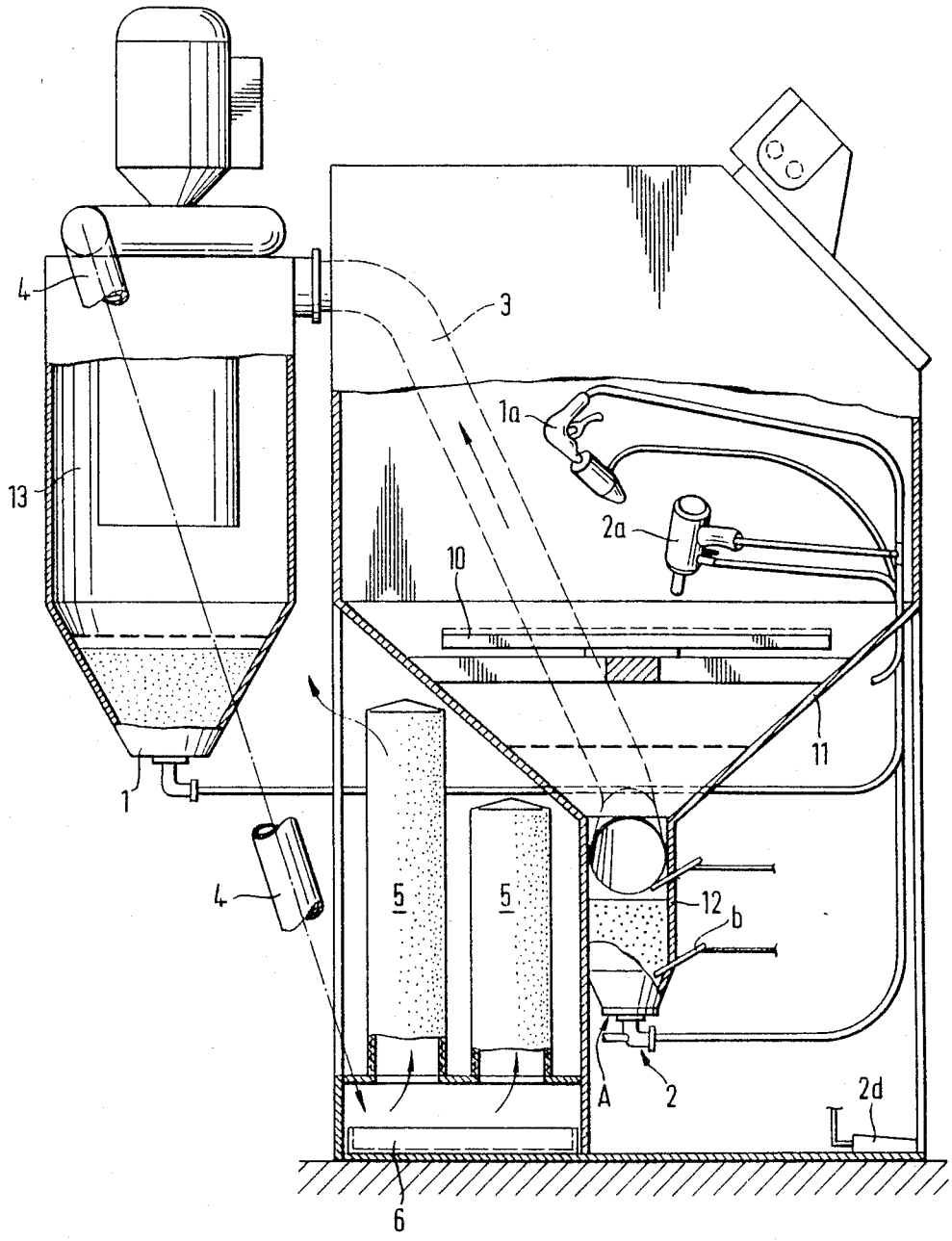

The invention will now be described in more detail with reference made to the accompanying drawings, in which FIG. 1 shows in a front view one embodiment of a box of the invention and FIG. 2 is a sectional view of the same box as seen from the side.

Figure 3:
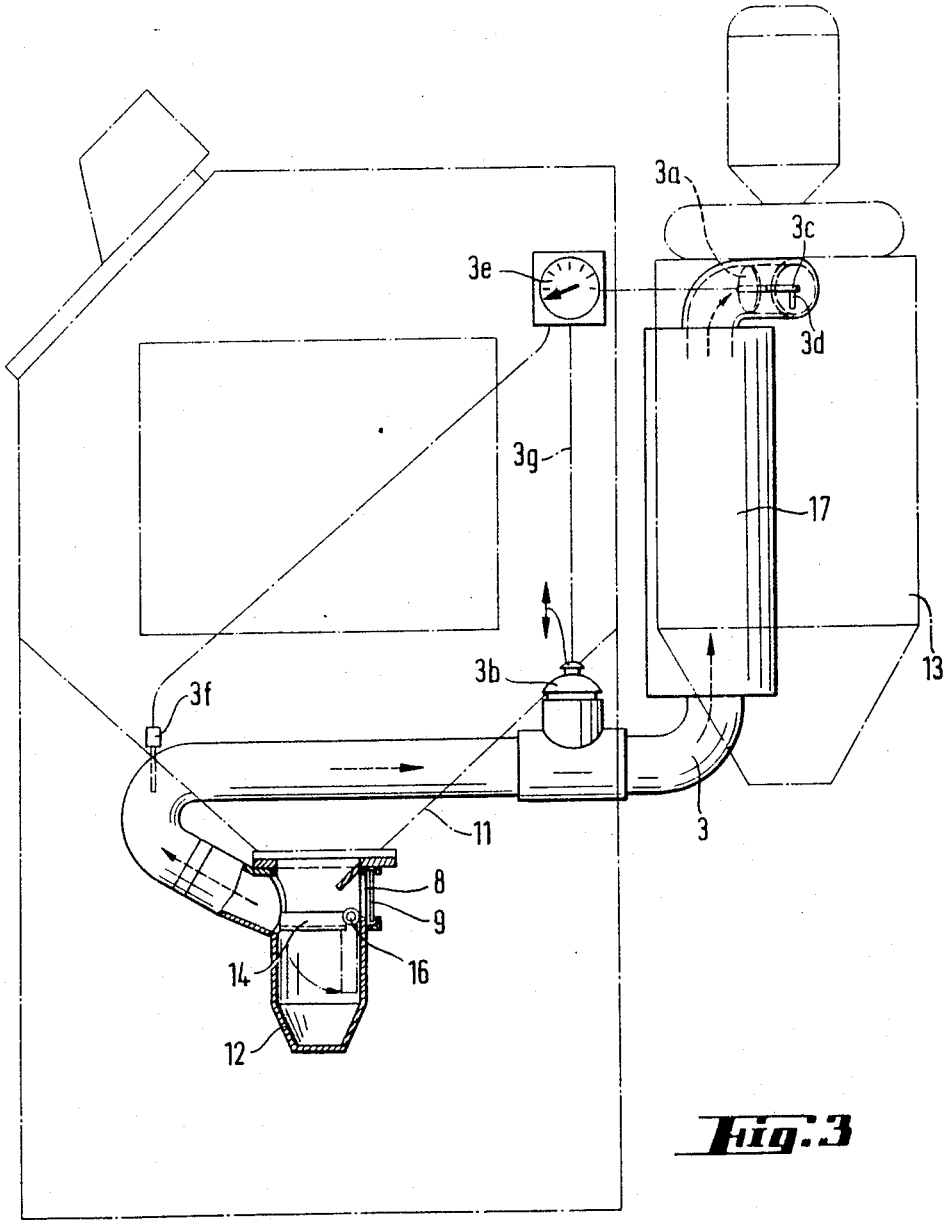
Figure 4:
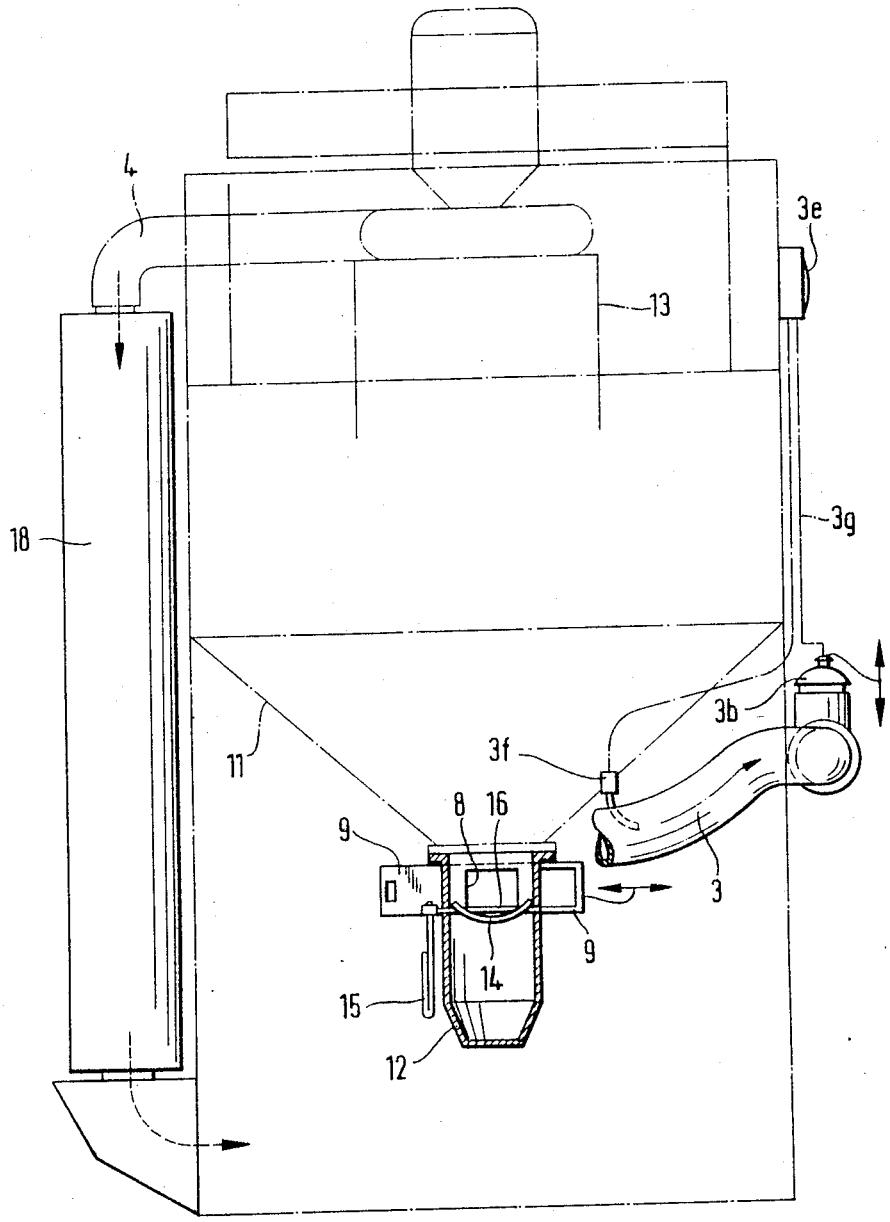

FIGS. 3 and 4 illustrate some further arrangements for developing the above embodiment so as to prevent steel grit and glass sand from mixing together.

Thus, applied in the invention are two systems having different operating principles, one of said systems using steel grit which travels from a vessel 12, mounted on the bottom of a box cone 11, by means of an additional ejector 2 and through an ejector gun 2*a* to the surface to be cleaned. The other system includes for glass sand an ejector gun 1*a* for sucking the cleaning material from the bottom 1 of a cyclone 13 to the surface to be cleaned. Pieces to be cleaned are placed on a table 10. When the device is operated, the dust from the surfaces to be cleaned passes along a duct 3 into the cyclone and further along a duct 4 to a dust microfilter 5 which in this embodiment is positioned in the bottom section of a cleaning box. The filtered dusts are removed to waste by means of a bin 6 mounted below the filters. The clogging of the outset or inlet end of said dry cleaning box suction duct 3 is prevented by means of electronic display elements for indicating the maximum and minimum level a and b of steel grit surface.

The steel grit surface is levelled by using a ball vibrator 7 and effective flow-off of dust is ensured by means of supplementary air openings or air ports 8 in the wall of a vessel 12 opposite to the intake of duct 3. When the cleaning is performed with steel grit, the main objective is the efficiency of cleaning. The ejector gun can thus be subjected to the unreduced network service pressure and the air inlet line is fitted with a water separator 2*b*. In the glass sand operation, the incoming air is provided with a water separator 1*b* as well as with a pressure reducer valve/gauge unit 1*c* for adjusting the pressure within the range of circa 2–5 bars. In the case of precious metals, for example, the proper pressure is 2 bars. When using steel grit, the ejector gun control is effected by means of a magnetic valve 2*c* and a pedal switch 2*d* while the passage of glass sand in ejector gun 1*a* is controlled by means of a finger-operated valve fitted on the gun.

The ratio of specific weights steel grit/glass sand is 3/1 and this has been utilized in the invention by combining a per se known operation of a cyclone external of the box and a per se known operation of a collection cone internal of the box whereby, in the cyclone operation, glass sand is sucked from the bottom part of cyclone 13 and in the latter operation the suction of steel grit is effected from vessel 12 provided in the bottom part of said blasting material collection cone 11. These systems are designed to operate in a single box by switching blasting guns with the consequence that the invention achieves substantial advantages over the prior art. The device is capable of effectively removing solid dirt from a variety of metal surfaces. Such metal surfaces may range from steel to soft metal castings. By means of two ejector guns the cleaning can be readily effected by directing glass sand from one of the guns and steel grit from the other to the surface of a piece to be cleaned.

After a prolonged glass sand operation, some glass sand may find its way into a steel grit container 12 below. This results in decreased cleaning efficiency in steel grit operation. The disintegration of glass sand further creates dust as glass sand cannot withstand high working pressure.

According to the invention, mixing of glass sand in with steel grit is prevented by means of a curved baffle plate 14 shown in FIGS. 3 and 4, the position of said baffle being horizontal in glass sand operation. A control plate 9 is now also in a position where supplementary air ports 8 are open. The rear part of baffle plate 14 is mounted on a shaft 16 which is journalled to steel grit container 12. By means of a lever 15 mounted on the end of shaft 16 said baffle plate 14 can be swivelled between horizontal position and upright position. In these extreme positions, said lever 15 engages suitable catches for holding baffle plate 14 in said positions.

On the other hand, during a prolonged steel grit operation, some steel grit might pass into the bottom part of cyclone 13 to mix in with glass sand. A result of this is the drawback that high-mass steel grit mixed in with glass sand operation corrodes the surfaces of pieces to be cleaned.

Mixing of steel grit in with glass sand is prevented by turning baffle plate 14 into the upright position and by shutting air ports 8 by control plate 9. In addition, said intake duct 3 is fitted with, for example a manually operated check plate 3*a* for reducing suction head or pressure in steel grit operation in a manner that under no circumstances steel grit will be sucked into cyclone 13. Said check plate 3*a* is journalled to be pivotable in intake duct 3 on a shaft 3*c* and it can be pivoted by means of a lever 3*d* mounted on shaft 3*c*.

The intake duct 3 can also be fitted with a disc valve 3*b* for the intake of supplementary air.

The control of check plate 3*a* and/or disc valve 3*b* can also be effected automatically by means of a pressure sensor (pressure detector) 3*f* through a measuring and control device 3*e*, said sensor being fitted at the outset or inlet of intake duct 3. It is possible to preset in said measuring and control device 3*e* a desired negative pressure reading which is sufficiently low to ensure that no steel grit will be sucked along.

In addition, said cyclone 13 can be further provided with a magnetic element which from time to time is cleaned of possible steel grit stuck to the surface of said magnetic element. Ducts 3 and 4 are further provided with silencers 17 and 18. Industrial depots, for example, often handle pieces to be cleaned, which have surfaces requiring two kinds of treatment (e.g. steel/glass sand).

The invention is not limited to the above embodiment but its construction may vary considerably within the scope of the annexed claims.

I claim:

1. A dry cleaning box for cleaning a workpiece by impingement of particulate material including first and second blasting guns for impinging first and second particulate materials onto a workpiece enclosed within an upper impingement zone of the box, a box funnel connected to said impingement zone of the box for receiving particulate material following impingement on the workpiece and extending downwardly to a funnel outlet, a lower vessel having a vessel inlet communicating with said funnel outlet for receipt of particulate material discharged from said box funnel, a cyclone having an intake duct connected to said box funnel adjacent said funnel outlet, and baffle means mounted adjacent said funnel outlet to direct said first particulate material into said intake duct and said second particulate material into said vessel, said cyclone being operably connected to supply said first particulate material to said first blasting gun, and said vessel being operably connected to supply said second particulate material to said second blasting gun.

2. A dry cleaning box as set forth in claim 1, wherein said baffle means comprises a baffle plate pivotable from a first position for directing said first particulate material into said intake duct to a second position for directing said second particulate material into said vessel.

3. A dry cleaning box as set forth in claim 2, wherein said baffle plate extends laterally towards said intake duct in said first position.

4. A dry cleaning box as set forth in claim 1, wherein said intake duct has a duct inlet opening into said box funnel, and said baffle means comprises a pivotable baffle plate, said baffle plate being pivotable to a horizontal position extending towards the lower edge of said duct inlet.

5. A dry cleaning box as set forth in claim 1, wherein a ball vibrator is operably connected to said vessel to vibrationally level the surface of said second particulate material within said vessel.

6. A dry cleaning box as set forth in claim 1, including electronic display means for indicating the level of particulate material in said vessel and preventing accumulation of sufficient particulate material to overflow into said intake duct.

7. A dry cleaning box as set forth in claim 1, wherein air ports are provided adjacent said funnel outlet for preventing said first particulate material from entering said vessel.

8. A dry cleaning box as set forth in claim 7, wherein an adjustable control plate is provided for opening and closing said air ports.

9. A dry cleaning box as set forth in claim 1, including dust microfilters operably connected to said cyclone to filter dust drawn into the cyclone through said intake duct.

10. A dry cleaning box as set forth in claim 1, wherein said first particulate material is sand and said second particulate material is steel grit.

11. A dry cleaning box as set forth in claim 10, wherein valve means are provided to reduce the suction within said intake duct to prevent said steel grit from entering said cyclone.

12. A dry cleaning box as set forth in claim 1, wherein the ratio of specific weights of said first and second particulate materials is 1:3.

* * * * *